US007758361B2

(12) United States Patent
Cheng

(10) Patent No.: US 7,758,361 B2
(45) Date of Patent: Jul. 20, 2010

(54) ELECTRICAL CARD CONNECTOR

(75) Inventor: Yung-Chang Cheng, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 41 days.

(21) Appl. No.: 12/313,953

(22) Filed: Nov. 26, 2008

(65) Prior Publication Data

US 2009/0176411 A1 Jul. 9, 2009

(30) Foreign Application Priority Data

Nov. 26, 2007 (TW) ..... 96144715 A

(51) Int. Cl.
*H01R 13/62* (2006.01)

(52) U.S. Cl. ..... 439/159; 439/630

(58) Field of Classification Search ..... 439/629, 439/607.53, 159, 941, 630
See application file for complete search history.

(56) References Cited

U.S. PATENT DOCUMENTS 5,004,430 A * 4/1991 DelGuidice et al. ..... 439/350
6,102,708 A * 8/2000 Kimura ..... 439/64
6,203,374 B1 * 3/2001 Huang et al. ..... 439/607.4
6,227,879 B1 * 5/2001 Dong ..... 439/92
7,150,650 B2 12/2006 Kuo
7,303,442 B2 * 12/2007 Fan ..... 439/630

FOREIGN PATENT DOCUMENTS

TW M281313 11/2005

* cited by examiner

*Primary Examiner*—Michael C Zarroli
(74) *Attorney, Agent, or Firm*—Andrew C. Cheng; Wei Te Chung; Ming Chieh Chang

(57) ABSTRACT

An electrical card connector (100) for mounting on a printed circuit board (PCB), includes an insulating housing (10), a plurality of terminals (13) received in the insulating housing, a metal shield (12) covering the insulating housing for defining a card receiving space, a grounding piece (14) and a conductor (108) electrically connected with the grounding piece and the metal shield. The grounding piece is attached to the insulating housing and has one surface electrically connected with the PCB.

11 Claims, 3 Drawing Sheets

ELECTRICAL CARD CONNECTOR

BACKGROUND OF THE INVENTION

1. Field of the Invention

The present invention relates generally to electrical card connectors, and more particularly to an electrical card connector with a structure preventing troubles caused by electrostatic discharge (ESD).

2. Description of Related Arts

With a digital development of the electric technology, removable electric products that are taken away with people themselves, such as Personal Digital Assistants (PDA), Digital Still Cameras (DSC) or etc, are more and more popular. The electric product requires an electrical card for storing message, and then transferring information between the electric product and another one. An electrical card connector is usually assembled on the circuit board of the electric product, and transferring information between the electric card and the circuit board. Static electricity is generated and retained on a metal shield of the electrical card connector when the electrical card is inserted. The static electricity may cause damage to the electrical card and even damage to the circuit board of the electric product. Therefore, the durability of the electrical card and the electric product are lowered by the static electricity.

Electrical card connectors existing in market usually form grounding elements for discharging the static electricity away from the metal shields of the electrical card connectors. A grounding element of an electrical card connector forms a first board with an upper surface contacting with an assembling portion and a second board with a lower surface contacting with a grounding piece of the circuit board, therefore, the metal shield comes in contact with the grounding piece of circuit board in virtue of the assembling portion and the grounding element for grounding purpose. The electrical card connector additionally forms a fixing portion on the insulating housing for fastening the grounding element therefore, it is difficult and troublesome for molding and also, it is material-wasting because of a two-layer framework of the grounding element.

Another electrical card connector having a grounding element is a SMT-type card connector. A pair of soldering pads is formed at two lateral sides of the insulating housing, with bottom surfaces soldering with the circuit board. However, bottom surfaces of the soldering pads are limited according to a miniaturization of the electrical card connector. For another reason, the electrical card connector is a reverse type card connector, in assembly, the electrical card connector is firstly soldered on the circuit board, and secondly, the electrical card connector is sent to go through a second Infra-red Reflow (IR Reflow), which may cause a melt of soldering material between the soldering pads and the circuit board and then, cause the electrical card connector to fall down from the circuit board.

Hence, an improved electrical card connector is desired.

SUMMARY OF THE INVENTION

Accordingly, an object of the present invention is to provide an electrical card connector with a structure preventing troubles caused by electro-static discharge (ESD).

To achieve the above object, an electrical card connector for mounting on a printed circuit board (PCB), includes an insulating housing, a plurality of terminals received in the insulating housing, a metal shield covering the insulating housing for defining a card receiving space, a grounding piece and a conductor electrically connected with the grounding piece and the metal shield. The grounding piece is attached to the insulating housing and has one surface electrically connected with the PCB.

Other objects, advantages and novel features of the invention will become more apparent from the following detailed description when taken in conjunction with the accompanying drawings.

DETAILED DESCRIPTION OF THE PREFERRED EMBODIMENT

Figure 1:
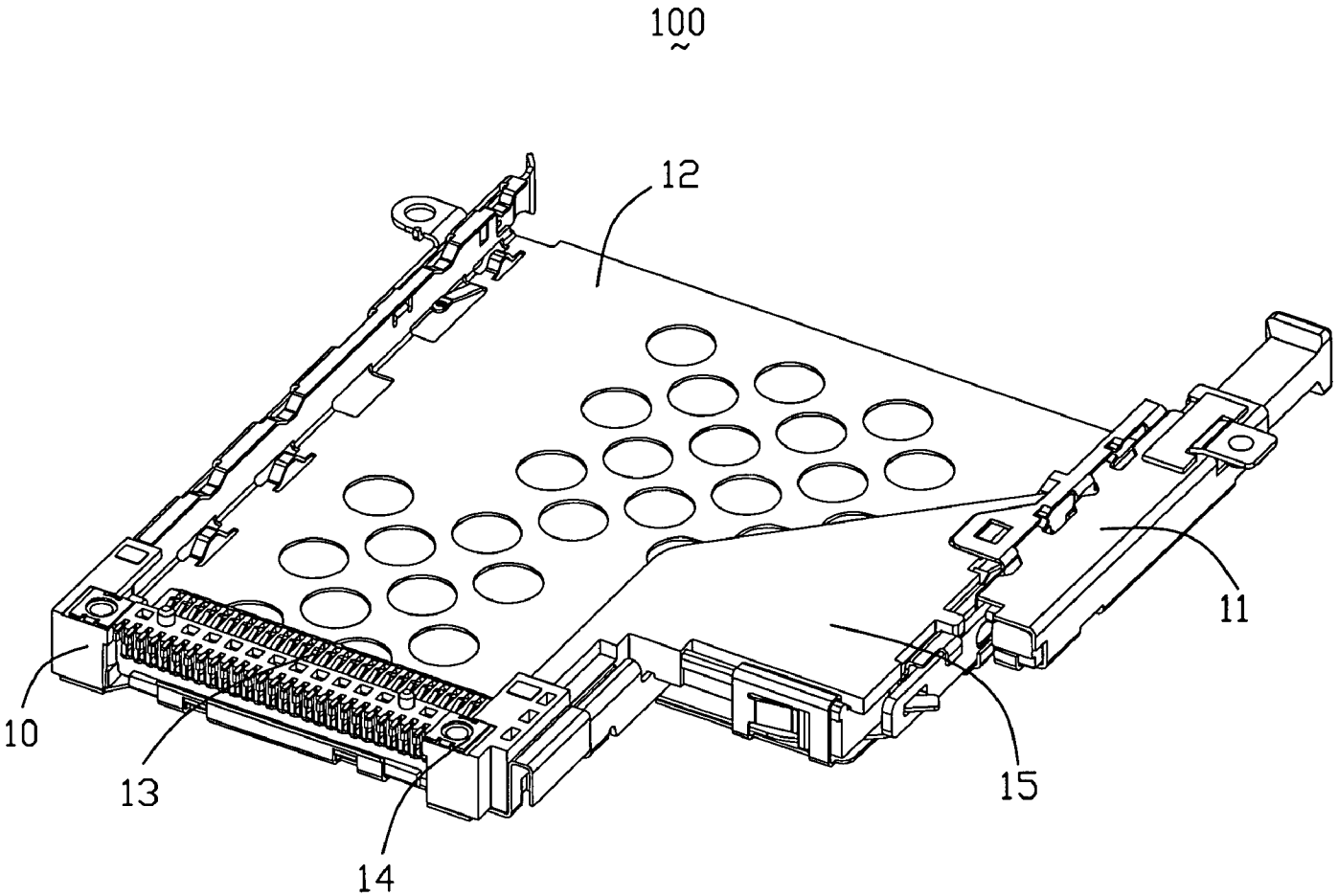
FIG. 1 is a perspective, assembled view of an electrical card connector according to the present invention.
Figure 2:
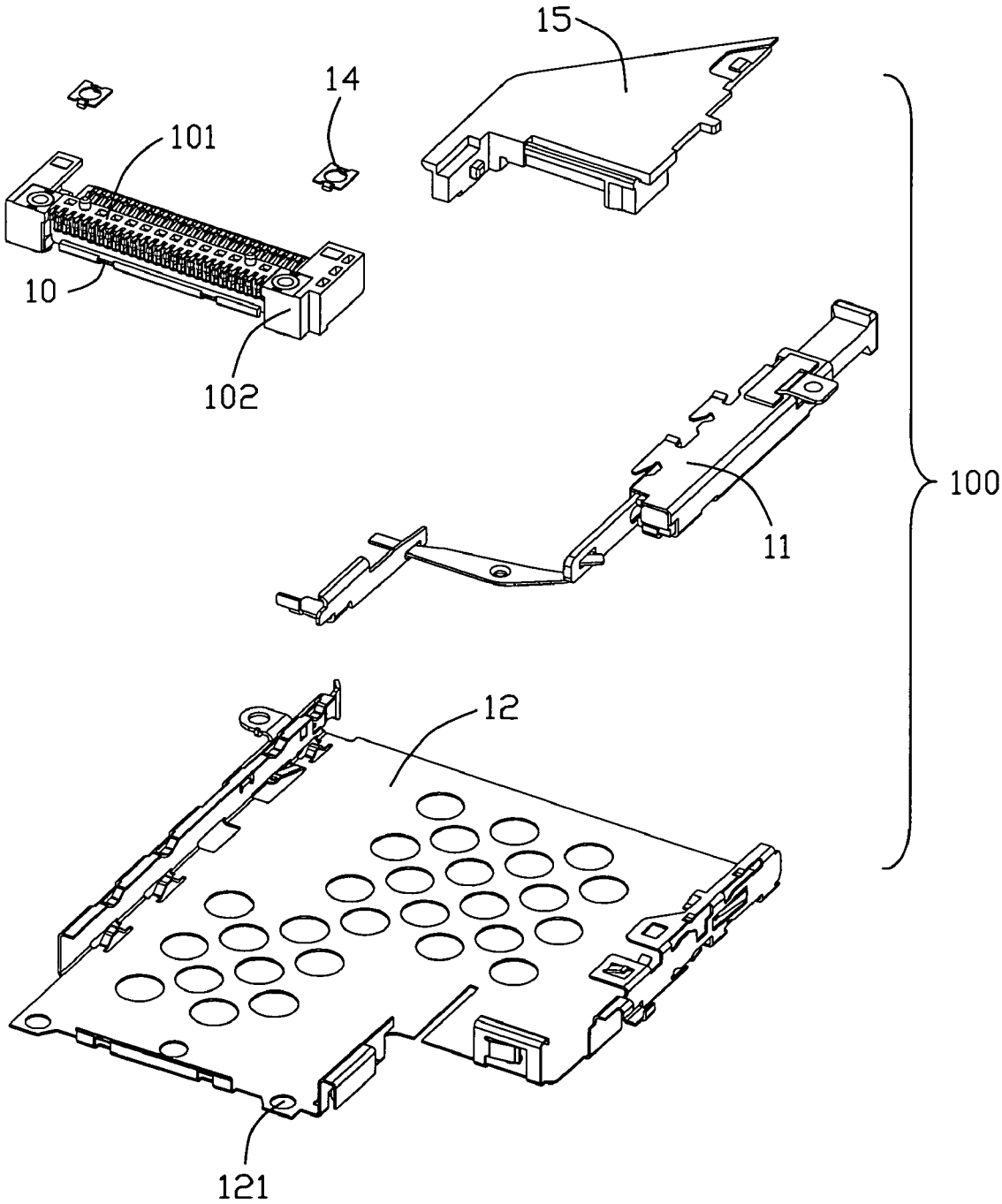
FIG. 2 is a perspective, exploded view of the electrical card connector.
Figure 3:
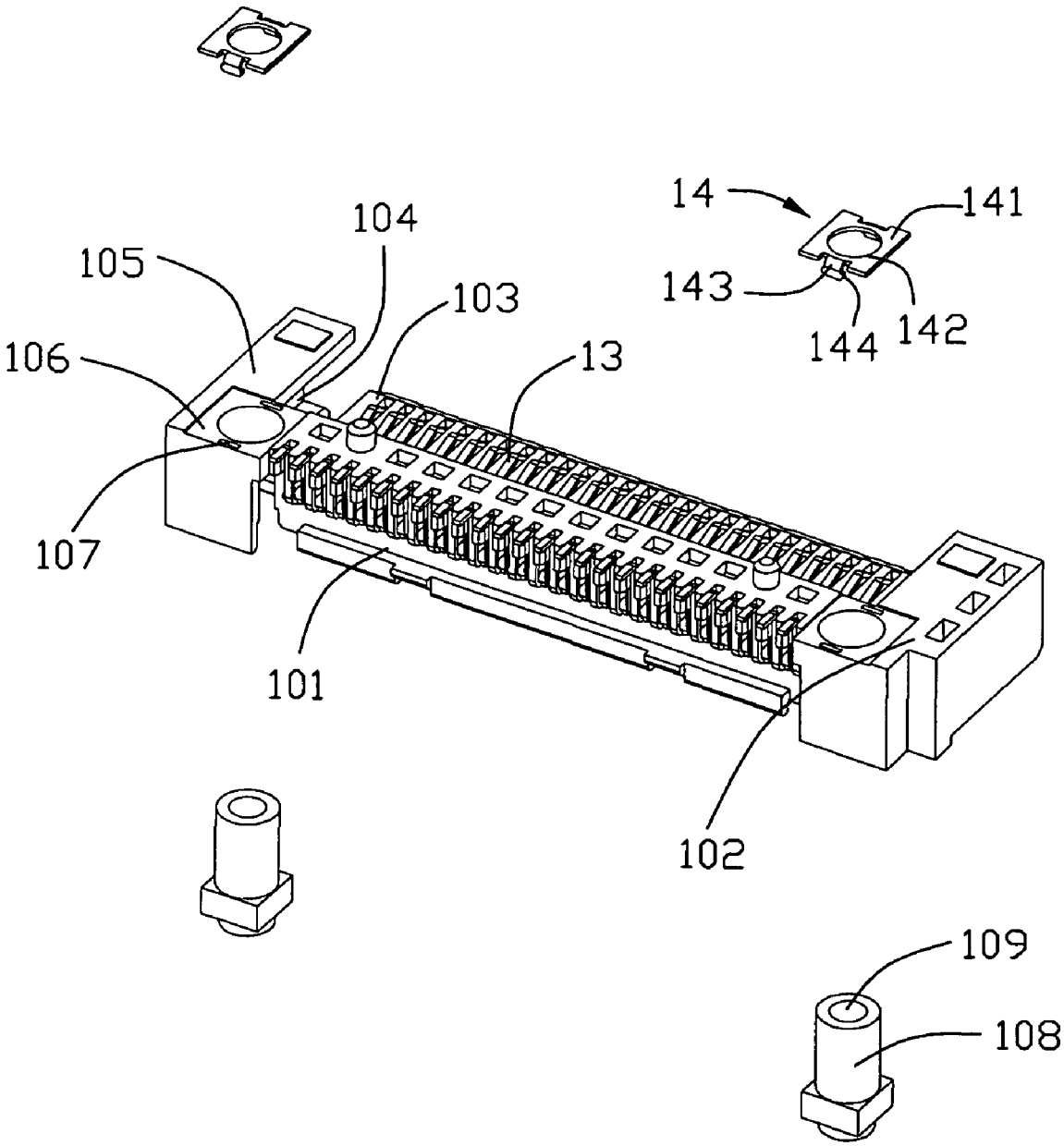
FIG. 3 is a perspective, partly exploded view of the electrical card connector.

FIGS. 1-3 illustrate an electrical card connector 100 in accordance with the present invention, assembled on a printed circuit board (PCB) (not shown) and comprising an insulating housing 10, a plurality of terminals 13 received in the insulating housing 10, a metal shield 12, an ejector 11 assembled at a side of the metal shield 12, a pair of grounding pieces 14 attached to the insulating housing 10 for grounding purpose and a base portion 15 of an approximately triangle shape for guiding purpose.

Referring to FIGS. 1-2, the metal shield 12 having an L-shaped configuration, shields over the insulating housing 10 for defining a card receiving space. The metal shield 12 defines a rear end (not labeled), through which an electrical card (not shown) is inserted into the card receiving space and a front end (not labeled) at which the insulating housing 10 is located. A pair of cavities 121 is defined at the front end of the metal shield 12.

Referring to FIGS. 2 and 3, the insulating housing 10 extending along a transverse direction relative to a card insertion/ejection direction, comprises a body portion 101 and a pair of arms 102 extending backwardly from two ends of the body portion 101. A mating portion 103 also extends backwardly from the body portion 101 and is sandwiched between the pair of arms 102 and forms a flat gradient together with the body portion 101. A plurality of terminal receiving passageways (not labeled) recess in the mating portion 103 together with the body portion 101 and partly receive the aligned terminals 13. The terminals 13 extend into the card receiving space and mate with the inserted electrical card electrically. The arms 102 form guiding slots 104 laterally, which face towards the card receiving space for guiding purpose. The arm 102 defines a contact surface 105 connecting with the PCB and the contact surface 105 defines a concaved portion 106 for receiving the grounding piece 14. A pair of interfering apertures 107 is formed on the concaved portion 106.

Referring to FIG. 3, the grounding piece 14 forms a main portion 141 for soldering with the PCB and a pair of fixing portions 143 extending conversely from two opposite edges of the main portion 141. An opening 142 is defined at the center of the main portion 141. Each fixing portion 143 forms a hook portion 144 fixedly received in the corresponding interfering aperture 107 for preventing the grounding piece 14 from falling off in the second IR Reflow.

Referring to FIGS. 2-3, the electrical card connector 100 further comprises a pair of conductors 108 with screw holes 109 defined therein. In assembly, a screw (not shown) goes through the cavity 121, the screw hole 109 and the opening 142 for fixing the electrical card connector 100 onto the PCB. Accordingly, static electricity generated and retained on the metal shield 12 of the electrical card connector 100 is discharged by the conductors 109 and the grounding pieces 14 and then the electrical card and the PCB are prevented from being destroyed by static electricity.

In the present invention, for the grounding piece 14 is formed on the insulating housing 10 instead of extending outwardly from two lateral sides of the insulating housing 10, it provides a larger area for soldering to achieve a firm retaining force between the electrical card connector 100 and the PCB. The grounding piece 14 is mainly a sheet member so that a simple structure of the grounding piece 14 can achieve a simple assembling process. The grounding piece 14 is received in the concaved portion 106 of the insulating housing 10 and decreases an altitude of the whole electrical card connector 100 to be compliant with a miniaturization of the electric product. More particularly, the hook portion 144 is fixedly received in the corresponding interfering aperture 107 for preventing the grounding piece 14 from falling off in the second IR Reflow.

While a preferred embodiment in accordance with the present invention has been shown and described, equivalent modifications and changes known to persons skilled in the art according to the spirit of the present invention are considered within the scope of the present invention as described in the appended claims.

I claim:

1. An electrical card connector for mounting on a printed circuit board (PCB), comprising: an insulating housing; a plurality of terminals received in the insulating housing; a metal shield covering the insulating housing for defining a card receiving space; a grounding piece attached to the insulating housing and having one surface electrically connected with the PCB; and a conductor electrically connected with the grounding piece and the metal shield, wherein the grounding piece forms a main portion soldered with the PCB and a plurality of fixing portions extending from the main portion, wherein the insulating housing defines a concaved portion and the grounding piece is received in the concaved portion, wherein the concaved portion defines a plurality of interfering apertures and the fixing portion of the grounding piece forms a hook portion inserted into the interfering aperture.

2. The electrical card connector as described in claim 1, wherein the metal shield defines a plurality of cavities at a front end thereof and the conductor defines a screw hole corresponding to the cavity for a screw going across to connect the metal shield with the grounding piece.

3. The electrical card connector as described in claim 1, wherein the insulating housing comprises a body portion and a pair of arms extending backwardly from two ends of the body portion and said concaved portions are defined on the arms.

4. The electrical card connector as described in claim 3, wherein each arm forms a guiding slot laterally.

5. The electrical card connector as described in claim 4, wherein the guiding slots face towards the card receiving space.

6. The electrical card connector as described in claim 3, wherein a mating portion extends backwardly from the body portion.

7. The electrical card connector as described in claim 6, wherein the mating portion forms a flat gradient together with the body portion.

8. The electrical card connector as described in claim 7, wherein a plurality of terminal receiving passageways recess in the mating portion together with the body portion and partly receive the aligned terminals.

9. The electrical card connector as described in claim 8, wherein the terminals extend into the card receiving space.

10. An electrical card connector comprising:

an insulative header defining opposite upper and bottom faces; a plurality of contacts disposed in the header; a metallic shell mounted upon the upper face; a hollow conductor extending vertically through said header beyond both said upper face and said bottom face, said conductor defining a through hole in a vertical direction; a metallic grounding piece positioned under and engaged with the bottom face for being seated upon a printed circuit board; and a screw extending through the shell, the through hole and the grounding piece under condition that electrostatic discharge occurs via a path from the shell, the conductor, the grounding piece and the printed circuit board, wherein the grounding piece defines a flat main body received in a recess in the bottom face.

11. The electrical card connector as claimed in claim 10, wherein said grounding piece includes a hook portion upwardly latched into the header.

* * * * *